US005244197A

United States Patent [19]

Helmstädter

[11] Patent Number: 5,244,197

[45] Date of Patent: Sep. 14, 1993

[54] FRICTION FEEDER FOR PAPER SHEETS

[75] Inventor: Maximilian Helmstädter, Villingen, Fed. Rep. of Germany

[73] Assignee: Mathia Bauerle GmbH, Georgen, Fed. Rep. of Germany

[21] Appl. No.: 943,767

[22] Filed: Sep. 11, 1992

[30] Foreign Application Priority Data

Sep. 12, 1991 [DE] Fed. Rep. of Germany ... 9111326[U]

[51] Int. Cl.[5] ..... B65H 3/04

[52] U.S. Cl. ..... 271/35; 271/121; 271/117

[58] Field of Search ..... 271/35, 117, 121, 124, 271/125, 126

[56] References Cited

U.S. PATENT DOCUMENTS

| | | | |
|---|---|---|---|
| 3,761,079 | 9/1973 | Azure | 27/41 |
| 4,991,831 | 2/1991 | Green | 271/121 |
| 5,004,218 | 4/1991 | Sardano et al. | 271/126 |
| 5,007,627 | 4/1991 | Giannetti et al. | 271/121 |
| 5,074,539 | 12/1991 | Wells et al. | 271/35 |

FOREIGN PATENT DOCUMENTS

| | | | |
|---|---|---|---|
| 0281820 | 9/1988 | European Pat. Off. | 271/121 |
| 913422 | 7/1980 | U.S.S.R. . | |
| 1234629 | 6/1971 | United Kingdom . | |

*Primary Examiner*—H. Grant Skaggs
*Attorney, Agent, or Firm*—McGlew and Tuttle

[57] ABSTRACT

The friction feeder for paper sheets is provided with a continuously rotating feed roller (2) arranged under a decollation plane and with an immobile decollating roller (4) arranged above it with parallel axis, forming an adjustable decollating gap. Continuously driven conveyor belts (14–17), whose delivery strands (14'–17') extend on both front sides of the feed roller (2) in the decollation plane are also provided. To achieve accurate starting and stopping of the decollation process, pre-decollating rollers (35, 36), which loosely lie on the delivery strands (14'–17') of the conveyor belts (14–17) in front of the decollating roller (4) in the delivery direction (arrow 7), and the pre-decollating rollers are mounted nonrotatably on a common, freely rotatable shaft (37), whose axis is parallel to the decollating roller (4), and the lowermost paper sheets of a sheet stack (23) located in front of the pre-decollating rollers are in contact with the pre-decollating rollers. These pre-decollating rollers (35, 36) can be lifted off from the delivery strands (14'–17') of the conveyor belts (14–17) by means of a lifting device (44–51) arranged under the decollation plane (1).

8 Claims, 4 Drawing Sheets

FRICTION FEEDER FOR PAPER SHEETS

FIELD OF THE INVENTION

The present invention pertains to a friction feeder for paper sheets, with a continuously rotating feed roller arranged under a decollation plane and with an immobile decollating roller arranged above it with parallel axis to form an adjustable decollating gap, as well as with continuously driven conveyer belts, whose delivery strands extend on both front sides of the feed roller in the decollation plane.

BACKGROUND OF THE INVENTION

In the prior-art friction feeders of this general type, sheet decollation, during which the actually lowermost sheet of the sheet stack is delivered through the decollating gap, is turned on and off only by switching the drive of the feed roller and of the conveyor belts on and off. Therefore, undefined trailing movements of the delivery means participating in sheet decollation or sheet feeding may occur during switching off in the case of very high delivery speeds, so that the lowermost paper sheet of the sheet stack will no longer assume its starting position in the area of the sheet stack after completion of the delivery movement and achieved standstill of the delivery means, but it will come to a stop somewhere between the decollating roller and the feed roller. This may lead to disturbances in the function of the friction feeder on restart, especially if the paper-processing machine arranged downstream of the friction feeder is adjusted to and dependent on a defined synchronism with the decollation processes of the friction feeder.

Another shortcoming of the prior-art friction feeders is the fact that their delivery speed and consequently also their work performance are limited to a certain, relatively low maximum, and the individual paper sheets must have a defined minimum thickness or surface quality in order to be able to be decollated in a trouble-free manner.

Friction feeders (GB 1,234,629) have also become known, in which a continuously rotating feed roller arranged under the decollation plane is vertically movable in order to be lowered, on interruption of the decollation process, in the downward direction from the decollation plane and consequently also from the lowermost sheet of the sheet stack in order to eliminate contact. The decollating gap in this prior-art device is formed by two stationary parts arranged behind the feed roller in the delivery direction, one of which parts forms a horizontal sliding surfaces and the other forms the vertical delimiting wall of a stack shaft, wherein the distance between the lower edge of the delimiting wall and the delivery surface corresponds to the thickness of one sheet. As in the other prior-art friction feeders, the sheet stack lies on the feed roller only with its own weight in this prior-art device as well, so that reliable decollation is no longer guaranteed below a certain minimum weight of the sheet stack.

This is also true of two other prior-art sheet decollating devices (OS-PS 3,761,079 and SU-PS 913,422), in which a friction lining is provided for lifting off the sheet stack from a feed roller, or, for lifting off the sheet stack from a suction roller, lifting devices in the form of rocking levers or pivotably mounted fingers are provided, which are pivoted upward to interrupt the decollation process and, to restart the decollation process, they are lowered to the extent that the sheet stack will again lie, with the actually lowermost sheet, on the feed roller or suction roller.

Aside from the above-mentioned disadvantage, these prior-art decollation devices are also unsuitable for reaching high decollation speeds and consequently high work outputs, even though the decollation process can be switched on and off relatively accurately by these lifting devices.

SUMMARY AND OBJECTS OF THE INVENTION

The primary object of the present invention is to provide a friction feeder for paper sheets of the type described in the introduction, which ensures reliable decollation of sheets as well as accurate turning on and off of the decollation process at a substantially increased work speed, i.e., delivery speed.

This task is accomplished according to the present invention by arranging, in front of the decollating roller in the direction of delivery, pre-decollating rollers which loosely lie at a supported point on the delivery strand of the conveyor belt and which are arranged nonrotatably on a common, freely rotatable shaft extending with parallel axis with the decollating roller, and with the pre-decollating rollers the lowermost paper sheets of a sheet stack located in front of these rollers are in contact and can be lifted off from the delivery strand of the conveyor belts by means of a lifting device arranged under the decollation plane.

A friction feeder of such a design has considerably improved decollation function and consequently permits considerably higher decollation speeds, i.e., considerably increased performance capacity, to be achieved. In particular, it is also possible to ensure that the actually lowermost or last sheet of the sheet stack is grasped from an exactly defined position when the decollation operation is started at a high work speed, or it is left in an exactly defined position on termination of the decollation process from a high work speed, so that synchronization problems with paper-processing machines arranged downstream can be avoided.

While the embodiments of the present invention relating to the design of the pre-decollating rollers, including the smooth low friction outer surface, applied adjustable spring force, rocking lever mounting and other disclosed features, contribute to the improvement of the decollation function and to an increase in performance capacity and work speed, the embodiment of the present invention including the provision of lifting fingers attached to a common rocking shaft, makes it possible to ensure, on termination of the decollation process, that the actually lowermost sheet of the sheed stack is completely lifted off from the drive means, i.e., the conveyor belts, and is held in an exactly defined position until the decollation operation is restarted by the lifting fingers being lowered under the decollation plane and the actually lowermost sheet of the sheet stack being again placed on the delivery strand of the conveyor belts in frictional connection.

The improved mode of operation of the friction feeder according to the present invention is based on various effects: On the one hand, the paper sheets located in the lower section of the stack, which are in contact, with their leading transverse edge at the lower circumferential sections of the pre-decollating rollers, with the pre-decollating rollers preceding the actual decollating rollers, are subjected to a mutual displacement corresponding to the curvature of these circumferential sections, and, on the other hand, the few paper sheets, which are moved under the pre-decollating rollers together with the actually lowermost paper sheet and are stopped at the actual decollating roller, are subjected by the pre-decollating rollers, which lie on them and are immobile, to an additional deceleration friction, which supports the decelerating function of the actual decollating roller to such an extent that the intake of two sheets is prevented with certainty.

Due to the pre-decollating rollers being mounted freely rotatably with their common shaft, neither the intake of the first sheet of a new sheet stack, nor the intake of the last sheet of the sheet stack in question is interfered with or influenced by the pre-decollating rollers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
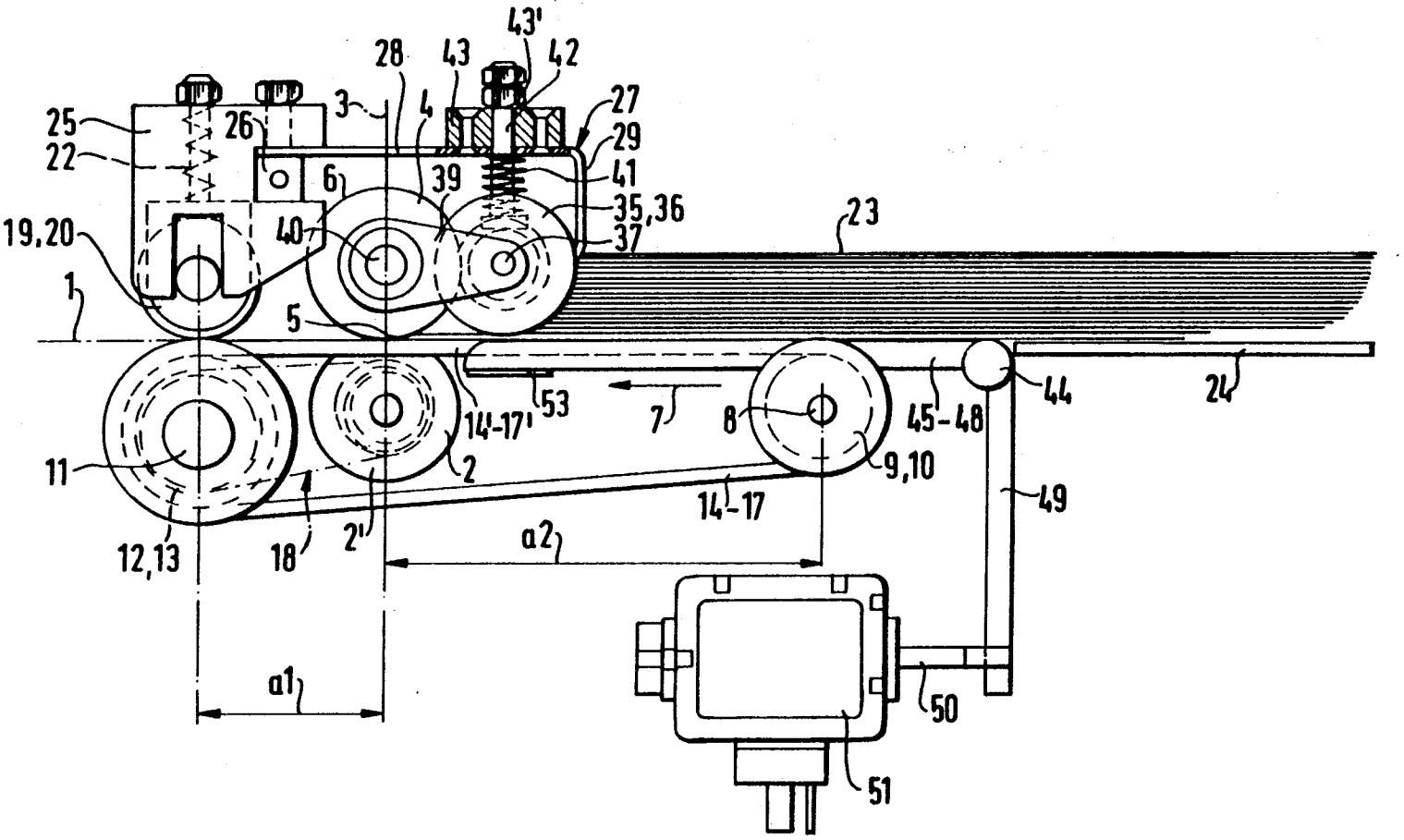
FIG. 1 is a simplified, schematic side view of a friction feeder in the working position.

The friction feeder shown in the drawing has, under a horizontal decollation plane 1, a continuously rotating feed roller 2, which forms a decollating gap 5 which is accurately adjustable to different paper thicknesses in the decollation plane 1 with an immobile decollating roller 4 arranged directly above it in the same vertical plane 3. While the feed roller 2 is mounted stationarily rotatably, the decollating roller 4, which has a rough jacket surface 6 with high coefficient of friction, is adjustable in the vertical direction in relation to the feed roller 2. In front of and behind the feed roller 2 in the delivery direction indicated by the arrow 7 and below the decollation plane 1, deflecting rollers 9 and 10 are mounted on a common shaft 8. Drive rollers 12 and 13 of four endless conveyor belts 14, 15, 16, and 17 are arranged on a common drive shaft 11 in pairs on both front sides of the feed roller 2 such that the upper delivery strands 14', 15', 16', and 17' of the conveyor belts 14, 15, 16 and 17 extend, with their outer surfaces, in the decollation plane 1.

It can be determined that the decollation plane 1 does not necessarily have to extend horizontally. It might also be sloped, e.g., slightly downward in the delivery direction.

The feed roller 2, which is provided with a rubber jacket 2' to achieve a high coefficient of friction, is in drive connection with the drive shaft 11 via a belt drive 18 such that its circumferential velocity is equal to the circumferential velocity of the conveyor belts 14 through 17, so that the feed roller 2 and the conveyor belts 14 through 17 run synchronously.

Pressure rollers 19, 20, whose contact pressure can be adjusted by a compression spring 22 acting on their common shaft 21 in the vertical direction, are in contact with the drive rollers 12 and 13.

As can be recognized from the drawing, the distance a1 between the centers of the drive shaft 11 and of the feed roller 2 is only half the distance a2 between the centers of the feed roller 2 and the shaft 8, on which the deflecting rollers 9, 10 are arranged. It is achieved as a result that the actually lowermost sheets of a sheet stack 23 will lie on the delivery strands 14' through 17' of the conveyor belts 14 through 17 over a relatively long section in front of the decollating gap 5 in order to bring about a good frictional connection between the conveyor belts and the actually lowermost paper sheet and, on the other hand, in order for the paper sheet passing through the decollating gap 5 to be able to be grasped relatively rapidly by the pressure rollers 19, 20 lying on the drive rollers 12, 13. A horizontal table plate 24, on which at least the rear section of the sheet stack 23 lies, is arranged in the decollation plane 1 at a certain distance in front of the deflecting rollers 9, 10.

A bale 27 made of bent sheet metal, which has a horizontal upper wall section 28 and a vertical wall section 29 bent at right angles downward, is attached to a bar 26 of square cross section extending in parallel to the shafts 8, 11 and 21 on a housing-like frame 25 above the decollation plane 1, and a wall section 30 extending obliquely in the forward direction, which is provided with two rectangular openings 31 and 32, is arranged at the lower end of the vertical wall section 29. Through the openings 31 and 32 extend segment-shaped sections 33 and 34 of two pre-decollating rollers 35 and 36, which are arranged nonrotatably on a common shaft 37 such that they lie on the delivery strands 14' and 15' or 16' and 17' of the conveyor belts 14 through 17, which delivery strands 14', 15', 16' and 17' extend on the front side in parallel to one another next to the decollating roller 4. The shaft 37 of the two pre-decollating rollers 35 and 36 is pivotably mounted on the shaft 40 of the decollating roller 4 by means of two rocking levers 38 and 39, so that the shaft 37 with the two pre-decollating rollers 35 and 36 can be lifted off from the delivery strands 14' through 17' of the conveyor belts 14 through 17 in the vertical direction. The shaft 37 is mounted freely rotatably in the two rocking levers 38 and 39, so that the two pre-decollating rollers 35 and 36 are also able to rotate freely, but only together, to guarantee straight sheet feed. The two pre-decollating rollers 35 and 36 have the same diameter and are provided with a smooth, preferably plastic-coated jacket surface, which has a considerably lower coefficient of friction than the jacket surface 6 of the decollating roller 4 or the jacket surface 2' of the feed roller 2.

The shaft 37 is influenced by a compression spring 41, whose vertical pressing force is adjustable, and which is arranged concentrically around a guide pin 42 between the horizontal wall section 28 of the bale 27 and the shaft 37. The guide pin 42 is guided axially adjustably in a guide bush 43 arranged on the upper side of the wall section 28 and can be adjusted by threaded nuts 43' fixed with lock nuts.

In the area in which the pre-decollating rollers 35, 36 lie on the delivery strands 14' through 17', these strands are supported by a support plate 53. Instead of the two decollating rollers 35 and 36, it would also be possible to arrange a single, continuous pre-decollating roller on the shaft 37.

Just below the decollation plane 1, four horizontal lifting fingers 45, 46, 47, and 48, which are attached to a common rocking shaft 44, are arranged between the delivery strands 14' through 17' of the conveyor belts 14 through 17. The lifting fingers extend, in pairs, under the pre-decollating rollers 35 and 36, and the pre-decollating rollers can be lifted off by them from the delivery strands 14' through 17' of the conveyor belts 14 through 17. To achieve this, the rocking shaft 44 is connected via a vertical lever 49 to the armature 50 of an electromagnet 51, and when it is energized, the electromagnet 51 is able to pivot the lifting fingers 45 through 48 from the resting position shown in FIG. 1, in which they do not affect the decollation operation of the friction feeder, into the position shown in FIG. 2, in which they are able to lift off the two pre-decollating rollers 35 and 36, together with the front section of the sheet stack 23, which [front section] they have grasped, from the delivery stands 14' through 17' of the conveyor belts 14 through 17, and thus to abruptly stop the decollation operation. However, it is still possible to pull a paper sheet grasped by the pressure rollers 19 and 20 completely off the sheet stack 23.

Figure 2:
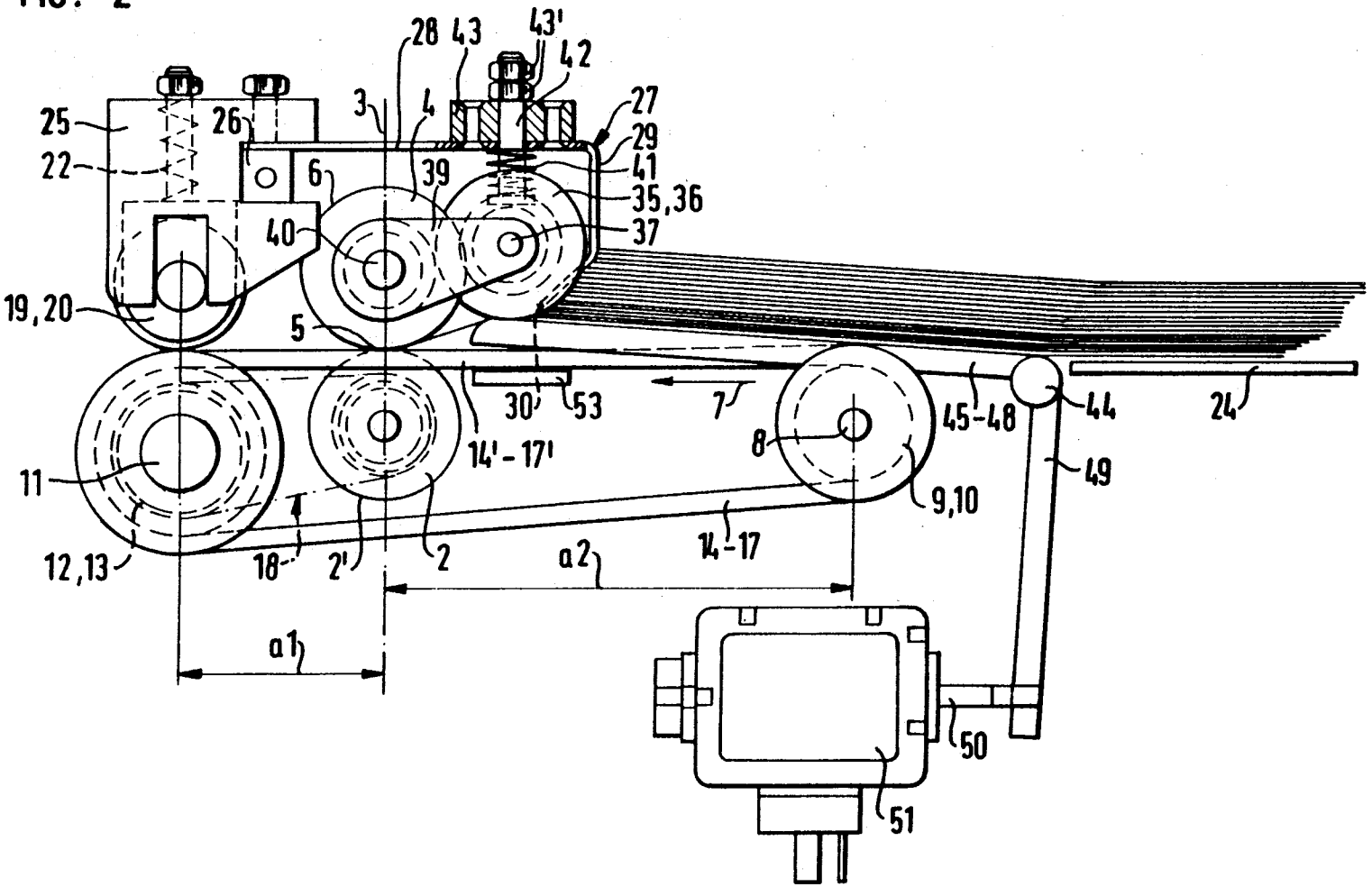
FIG. 2 is the same view of the friction feeder according to FIG. 1, but in the rest position.
Figure 3:
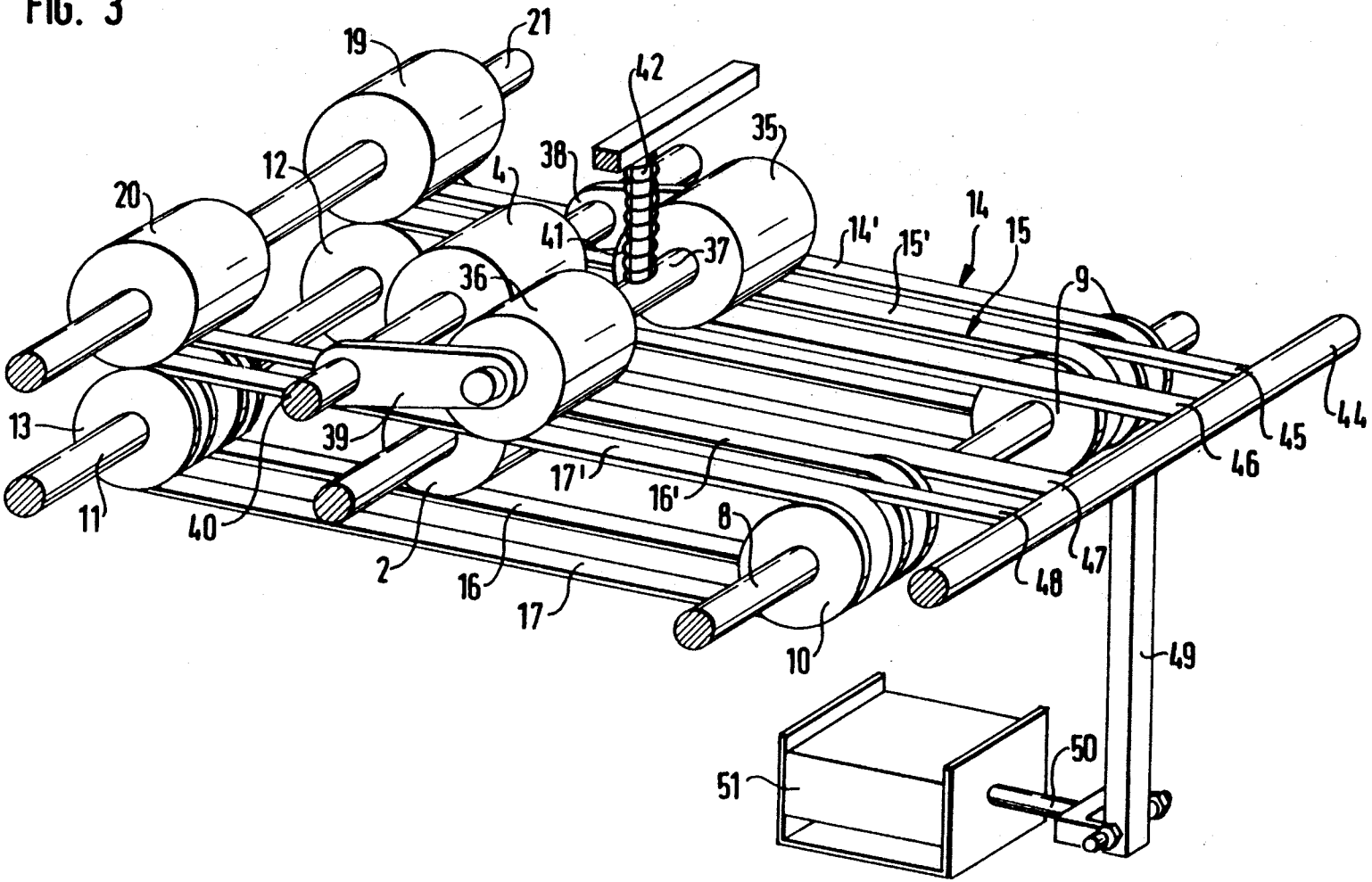
FIG. 3 is a simplified perspective view of the friction feeder according to FIGS. 1 and 2.
Figure 4:
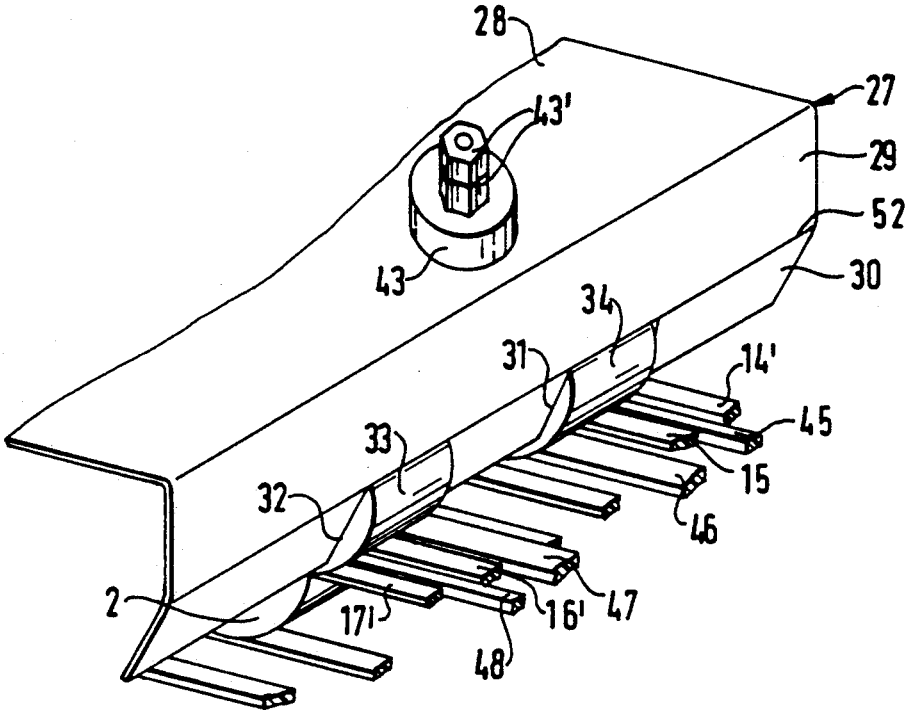
FIG. 4 is a perspective view of a detail of the friction feeder, which was omitted in FIG. 3 for reasons of clarity.

As is apparent from FIGS. 1 and 2, the bending edge 52 (see FIG. 4), at which the lower, oblique wall section 30 of the bale 27 begins, is located at a vertically spaced location above the decollation plane 1, and this distance is approximately equal to half the diameter of the pre-decollating rollers 35 and 36. It can also be recognized that in their working position represented in FIGS. 1, 3, and 4, in which they lie on the delivery strands 14' through 17', the pre-decollating rollers 35 and 36 project, in a segment-like manner, from the plane of the wall section 30 by about one fourth of their circumference.

Since the above-described friction feeder is intended for use mainly in conjunction with a so-called prestacking unit, which continuously refills the sheet stack 23 at the rate it is used up, and such that the sheet stack 23 is constantly maintained at a level that approximately corresponds to half the diameter of the pre-decollating rollers 35 and 36, the relatively small height of the vertical wall section 29 of the bale 27 as a front-side stop face for the paper stack is sufficient.

Due to their the segment-like sections 33 and 34 projecting from the openings 31 and 32 of the oblique wall section 30, the pre-decollating rollers 35 and 36 cause the actually lowermost paper sheets of the sheet stack 23 to be displaced in a wedge-shaped, tapering pattern, especially in the lower area, without preventing additional sheets of paper, in addition to the lowermost sheet, from being simultaneously fed to the immobile decollating roller 4. Due to their smooth surface, the pre-decollating rollers 35 and 36 make it possible for two or more sheets of paper to be always simultaneously in contact with the jacket surface of the immobile decollating roller 4 in the vicinity of the decollating gap 5 during the entire decollation operation. Since these paper sheets are prevented by the decollating roller 4 from being fed further, they are stopped. As a consequence, the pre-decollating rollers 35 and 36 lying on these immobile paper sheets are stopped as well, but they ensure a frictional connection between the actually lowermost paper sheet and the delivery strands 14' through 17 of the conveyor belts 14 through 17 by their own weight and possibly by part of the spring force acting on their the shaft 37. At the same time, they exert an additional decelerating effect on the paper sheets stopped by the decollating roller 4, and this decelerating effect is understandably most effective on the actually topmost of these paper sheets, on which the pre-decollating rollers 35, 36 directly rest.

Thus, the pre-decollating rollers 35 and 36 bring about a substantial improvement of the decollation process and also a substantial increase in the decollation performance, i.e., an increase in the work speed of this friction feeder, and the fact that the lifting fingers 45 through 48 make it possible, in conjunction with the pre-decollating rollers 35 and 36, to stop and restart the decollation operation in an accurately defined manner, should also be considered to be an essential improvement.

While a specific embodiment of the invention has been shown and described in detail to illustrate the application of the principles of the invention, it will be understood that the invention may be embodied otherwise without departing from such principles.

What is claimed is:

1. A friction feeder for paper sheets, comprising:

a continuously rotating feed roller arranged under a decollation plane;

an immobile decollating roller which is arranged above said continuously rotating feed roller, said immobile decollating roller having an axis parallel to an axis of said continuously rotating feed roller to form an adjustable decollating gap;

continuously driven conveyor belts including delivery strands extending in the decollation plane on both sides of said feed roller;

pre-decollating rollers lying on said delivery strands of said conveyor belts at a supported sight, said pre-decollating rollers being arranged in front of said decollating roller with respect to a delivery direction, said pre-decollating rollers being arranged non-rotatably on a common, freely rotatable shaft, said common freely rotatable shaft having an axis extending in parallel to said axis of said decollating roller;

a sheet stack located in front of said pre-decollating rollers including a lower most paper sheet in contact with said pre-decollating rollers; and lifting means for lifting the pre-decollating rollers from said delivery strands of said conveyor belts, said lifting means being arranged under said decollation plane.

2. A friction feeder according to claim 1, wherein:

said pre-decollating rollers are provided with smooth jacket surfaces, said surfaces having a low coefficient of friction.

3. A friction feeder according to claim 1, further comprising:

adjustable spring force means acting on said pre-decollating roller shaft from above for increasing contact pressure by which said pre-decollating rollers press paper sheets onto said delivery strands of said conveyor belts.

4. A friction feeder according to claim 1, wherein:

said pre-decollating roller shaft and two pre-decollating rollers are mounted in two rocking levers, said rocking levers being pivoted around said axis of the decollating roller.

5. A friction feeder according to claim 1, wherein:

said conveyor belt comprise at least two conveyor belts arranged on each front side of said feed roller.

6. A friction feeder according to claim 1, wherein:

said conveyor belts are guided via drive rollers arranged behind said feed roller in a delivery direction and guided via deflecting rollers arranged in front of said pre-decollating rollers.

7. A friction feeder according to claim 6, wherein:

said drive rollers are provided with pressure rollers arranged above them.

8. A friction feeder according to claim 1, wherein:

said lifting means includes fingers located in a common plane directly below said decollation plane, each finger of said fingers being positioned between or beside corresponding delivery strands, said fingers being attached to a common rocking shaft which can be actuated by an electromagnet, said fingers being arranged in front of said deflecting rollers of said conveyor belts and having an axis which is parallel to said continuously rotating feed roller axis.

* * * * *